US008254610B2

(12) United States Patent
Heerlein et al.

(10) Patent No.: US 8,254,610 B2
(45) Date of Patent: Aug. 28, 2012

(54) HEARING AID WITH A BATTERY COMPARTMENT, AND BATTERY COMPARTMENT FOR A HEARING AID, EACH HAVING A LOCKING MECHANISM FOR THE BATTERY COMPARTMENT

(75) Inventors: Markus Heerlein, Singapore (SG); Markus Hubert, Waldsachsen (DE); Harald Klemenz, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 570 days.

(21) Appl. No.: 12/420,848

(22) Filed: Apr. 9, 2009

(65) Prior Publication Data

US 2010/0260366 A1 Oct. 14, 2010

(30) Foreign Application Priority Data

Apr. 9, 2008 (DE) ..... 10 2008 018 041

(51) Int. Cl.
*H04R 25/00* (2006.01)

(52) U.S. Cl. ..... 381/323; 381/322; 381/324; 381/328

(58) Field of Classification Search ..... 381/323
See application file for complete search history.

(56) References Cited

U.S. PATENT DOCUMENTS

| | | | |
|---|---|---|---|
| 2008/0013765 | A1 | 1/2008 | Nielsen et al. |
| 2008/0044049 | A1 | 2/2008 | Ho et al. |

FOREIGN PATENT DOCUMENTS

| | | | |
|---|---|---|---|
| DE | 9406447 | U1 | 6/1994 |
| EP | 0674465 | A1 | 9/1995 |
| EP | 1207312 | A2 | 5/2002 |
| WO | 2006081818 | A1 | 8/2006 |
| WO | WO 2006081818 | A1 * | 8/2006 |
| WO | 2007024194 | A1 | 3/2007 |

OTHER PUBLICATIONS

European Search Report dated Jul. 20, 2009.
Infobroschüre S.A.T., Best Nr. A91100-M5100-8977; Others.
Phonak AG, 029-0641-017V4.02/2007-02/FO Printed in Switzerland; Others; 2007.

* cited by examiner

*Primary Examiner* — Elvin G Enad
*Assistant Examiner* — Ronald Hinson
(74) *Attorney, Agent, or Firm* — Laurence A. Greenberg; Werner H. Stemer; Ralph E. Locher

(57) ABSTRACT

A hearing aid has a housing, a battery compartment, and a locking mechanism for the battery compartment. A shaft which is arranged on the housing or the battery compartment, and a slide having a hole which forms a fit with the shaft, such that the slide can be moved on the shaft in order to lock and unlock the battery compartment in the housing. The hole has a circular cross section, and the shaft has a cross section which is not a circle, with rotational symmetry when rotated through 360°/n, where n is an integer greater than 1. A battery compartment for a hearing aid has a locking mechanism such as this. Because a cross section of said shaft is different from the cross section of the hole in the battery compartment, the shaft is connected to the hole in the battery compartment only at a number of points. This ensures that the slide is held adequately on the shaft even in the event of a production tolerance on the one hand, while, on the other hand, the slide can move on the shaft with little resistance. In a preferred embodiment the shaft is trilobular in cross-section.

14 Claims, 6 Drawing Sheets

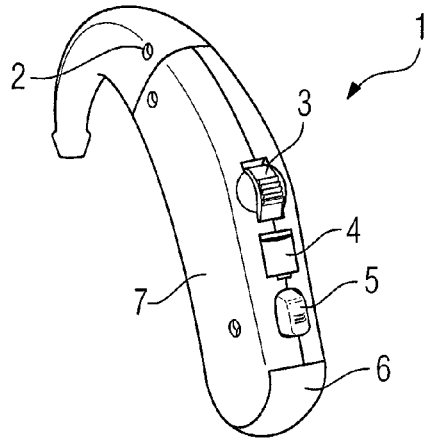
FIG. 1
PRIOR ART
FIG. 2 PRIOR ART
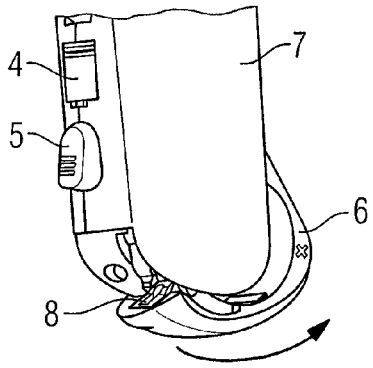
FIG. 3 PRIOR ART
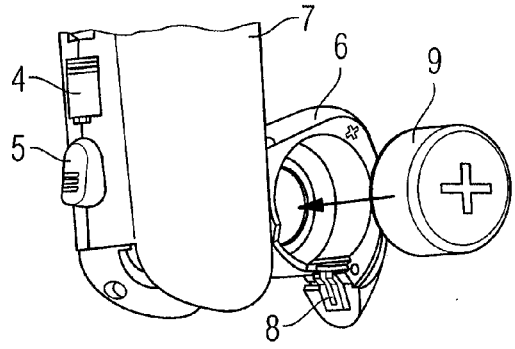
FIG. 4 PRIOR ART
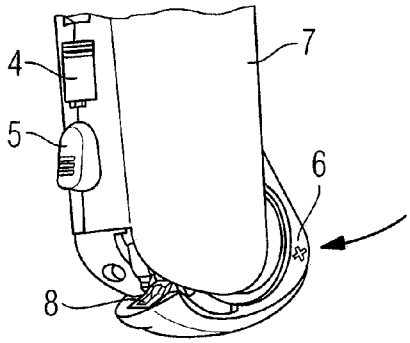

FIG. 5 PRIOR ART
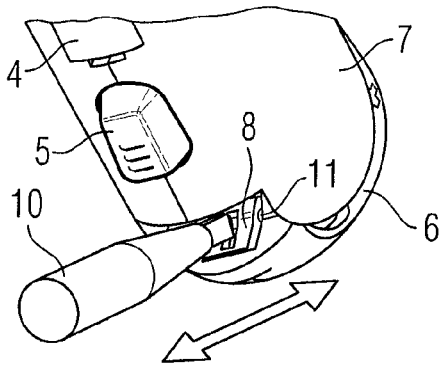
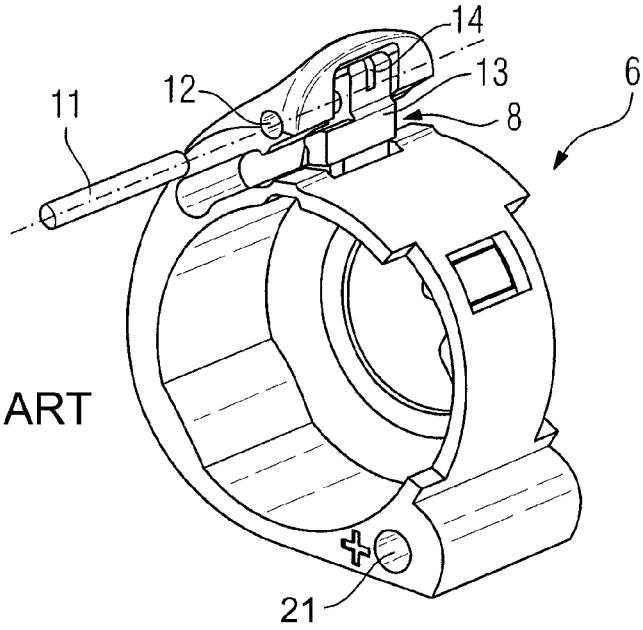
FIG. 6
PRIOR ART
FIG. 7 PRIOR ART
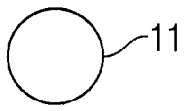
FIG. 8 PRIOR ART
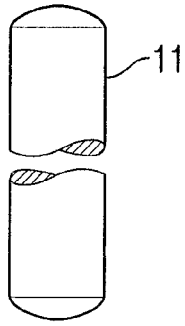

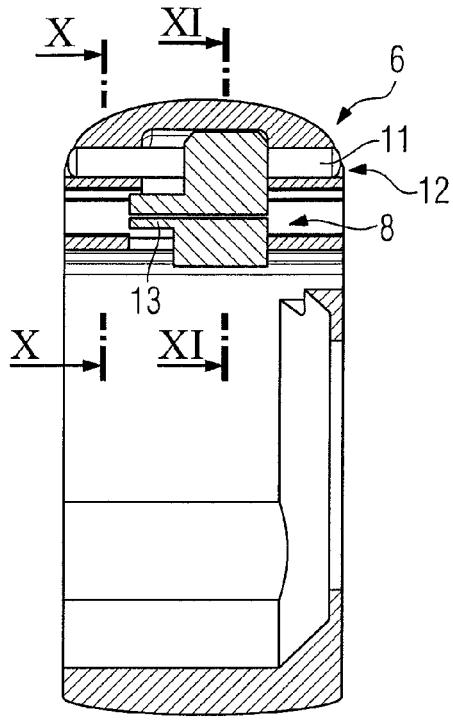
FIG. 9
PRIOR ART
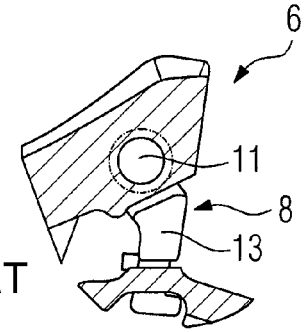
FIG. 10
PRIOR ART
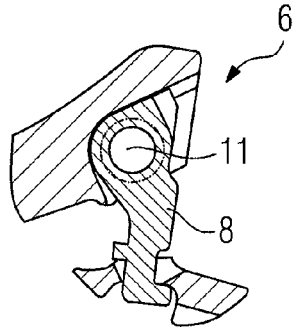
FIG. 11
PRIOR ART
FIG. 12 PRIOR ART
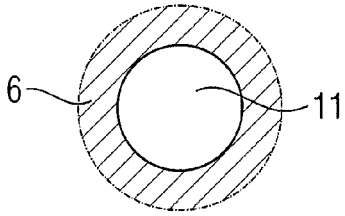
FIG. 13 PRIOR ART
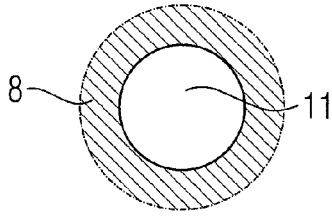

HEARING AID WITH A BATTERY COMPARTMENT, AND BATTERY COMPARTMENT FOR A HEARING AID, EACH HAVING A LOCKING MECHANISM FOR THE BATTERY COMPARTMENT

CROSS-REFERENCE TO RELATED APPLICATION

This application claims the priority, under 35 U.S.C. §119, of German application DE 10 2008 018 041.6, filed Apr. 9, 2008; the prior application is herewith incorporated by reference in its entirety.

BACKGROUND OF THE INVENTION

Field of the Invention

The invention relates to a hearing aid having a housing, a battery compartment and a locking mechanism for the battery compartment, comprising a shaft which is arranged on the housing or the battery compartment, and a slide having a hole which forms a fit with the shaft, such that the slide can be moved on the shaft in order to lock and unlock the battery compartment in the housing. Such a hearing aid is known from the Siemens INFINITY Pro hearing aid. The invention furthermore relates to a battery compartment for a hearing aid having a locking mechanism comprising a shaft, which is arranged on the battery compartment, and a slide having a hole which forms a fit with the shaft, such that the slide can be moved on the shaft in order to lock and unlock the battery compartment in the housing of the hearing aid. A battery compartment such as this is known from the same above-mentioned device.

Commercially available electrical hearing aids have a housing with a battery compartment for holding a battery. In order to prevent the battery compartment from being opened accidently, and the battery thus falling out, the battery compartment is locked in the housing by a locking mechanism. This locking mechanism is frequently equipped with a child-proof facility, in such a way that the locking mechanism can be opened only by a special tool, for example a small screwdriver or a pointy object.

One known locking mechanism has a slide with a hole which forms a fit with the shaft, such that the slide is arranged such that it can be moved on the shaft in order to lock and unlock the battery compartment in the housing. A fit should be understood as meaning a connection between two mutually engaging parts with dimensions that are matched to one another. In the present case, the shaft engages in the hole, with the external diameter of the shaft corresponding approximately to the internal diameter of the hole. A fit can be matched to the respective requirements by variation of the tolerances of the diameters of the shaft and of the hole, with a clearance fit, a transition fit or else an interference fit being generally known.

Until now, both the hole and the shaft have had a circular cross section. Because of the small size of the hearing aid—and as a consequence of this the small size of the cross section of the hole and of the shaft—it is difficult to manufacture an accurately matched fit. If the cross section of the hole is too large in comparison to the cross section of the shaft, the locking mechanism may become unlocked on its own during operation of the hearing aid, possibly even allowing the battery to fall out of it. This represents a risk particularly for children, to whom the battery should not be accessible.

However, if the cross section of the hole is too small in comparison to the cross section of the shaft, the locking mechanism is difficult to unlock, even with a special tool. If the fit is in this way designed to be too firm, this can even lead to damage to the locking mechanism when an unlocking attempt is made.

German utility patent DE 94 06 447 U1 (Gebrauchsmuster) discloses a hearing aid which has a battery drawer, which can pivot, with a locking mechanism. The locking mechanism comprises a slide which, when in the locking position, blocks the pivoting movement of the battery drawer.

SUMMARY OF THE INVENTION

It is accordingly an object of the invention to provide a hearing aid and a battery compartement which overcomes the above-mentioned disadvantages of the heretofore-known devices and methods of this general type and which provides for a locking mechanism which can be unlocked easily and offers reliable protection against becoming unlocked on its own.

With the foregoing and other objects in view there is provided, in accordance with the invention, a hearing aid, comprising:

a housing;

a battery compartment disposed in said housing; and a locking mechanism for the battery compartment, said locking mechanism including a shaft disposed on said housing or said battery compartment and a slide having a hole forming a fit with said shaft, wherein said slide is movable on said shaft in order to selectively lock and unlock said battery compartment in said housing;

said hole having a substantially circular cross section and said shaft having a non-circular cross section with rotational symmetry upon being rotated through 360°/n, where n is an integer and is equal or greater 2.

With the above and other objects in view there is also provided, in accordance with the invention, a battery compartment for a hearing aid with a housing and a battery compartment locking mechanism. The assembly comprises a shaft mounted to the battery compartment and a slide having a hole forming a fit (i.e., a seat) with the shaft, wherein said slide is movably disposed on said shaft for selectively locking and unlocking the battery compartment in the housing of the hearing aid. According to the invention, the hole has a circular cross section and said shaft having a non-circular a cross section with rotational symmetry, upon rotation through 360°/n, where n is an integer greater than 1.

Since the hole in the slide has a circular cross section and the shaft has a cross section which is not circular, with rotational symmetry, the shaft touches the hole only at a number of points, thus reducing the static friction and allowing the locking mechanism to be opened easily. On the other hand, this matching of the cross sections allows the slide to be held securely on the shaft, since the cross section of the shaft can easily be deformed in the hole. The rotational symmetry of the shaft ensures that the shaft is held securely in the hole.

In particular, this design principle allows an interference fit between the hole in the slide and the shaft without this making it considerably more difficult to unlock the locking mechanism. An interference fit is particularly insensitive to fluctuations in manufacturing tolerances, since, even if the cross section of the shaft turns out to be smaller than intended, the shaft nevertheless makes firm contact with the hole in the slide, thus preventing the locking mechanism from being released on its own.

The cross section of the shaft is rotationally symmetrical such that, on rotation through an angle of 360°/n about the center of rotation, it is imaged on itself, where n is an integer and is greater than 1. One example of such a cross section is an ellipse (n=2) which is imaged on itself when rotated through 180°.

The same inventive effect is achieved when the cross section of the hole and the cross section of the shaft are interchanged with one another.

It is equivalent in the context of the invention whether the shaft is attached to the housing of the hearing aid or directly to the battery compartment itself.

If the shaft is attached to the housing, the slide of the locking mechanism engages in a corresponding locking holder in the battery compartment when the battery compartment is being locked. Conversely, when the shaft is attached to the battery compartment, the slide of the locking mechanism engages in a locking holder of the housing of the hearing aid.

The shaft is attached to the housing or to the battery compartment in a particularly simple manner by means of a fit with a hole in the housing or the battery compartment. In order to offer particularly secure retention, this hole has the same cross section as that of the shaft itself.

The force-fitting and interlocking fit offers considerably stronger retention than the fit between the shaft and the hole in the slide. The shaft is therefore not pushed out of the hole in the housing or the battery compartment when the slide is moved. This therefore reduces the risk, which exists with conventional hearing aids, of damage when the locking mechanism is being unlocked, in a simple manner, but nevertheless effectively.

It is particularly advantageous for the shaft to have a trilobular cross section (n=3) since a cross section such as this brings the shaft into contact with the circular wall of the hole in the slide at three points, and can also be produced easily, by virtue of the simple shape, in a size which is suitable for a hearing aid. Furthermore, a shaft with a cross section such as this is particularly mechanically robust.

A cylindrical shaft with a base area corresponding to one of the abovementioned cross sections can be produced particularly easily and allows the slide to be moved easily in a straight line along the shaft. In the case of a trilobular cross section, the shaft is in contact with the hole in the slide along three parallel lines in the longitudinal direction of the shaft, so that the slide can easily be moved along these lines.

However, shaft shapes that are not cylindrical can also be combined with the principle of the invention. For example, the shaft may have a helical shape.

Other features which are considered as characteristic for the invention are set forth in the appended claims.

Although the invention is illustrated and described herein as embodied in a hearing aid with a battery compartment, and battery compartment for a hearing aid, each having a locking mechanism for the battery compartment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 shows a perspective illustration of a prior art hearing aid;

FIGS. 2-4 are perspective views showing the opening and closing of the battery compartment of the hearing aid shown in FIG. 1;

FIG. 5 shows a locking mechanism of the hearing aid shown in FIG. 1;

FIG. 6 is an isolated perspective illustration of the battery compartment from the hearing aid shown in FIG. 1;

FIG. 7 is a cross-section through the shaft of the battery compartment illustrated in FIG. 6;

FIG. 8 is a broken side-elevation thereof;

FIG. 9 is a cross-sectional view through the battery compartment of FIG. 6;

FIGS. 10-13 are cross-sectional views taken through the illustration of FIG. 9;

DETAILED DESCRIPTION OF THE INVENTION

Figure 14:
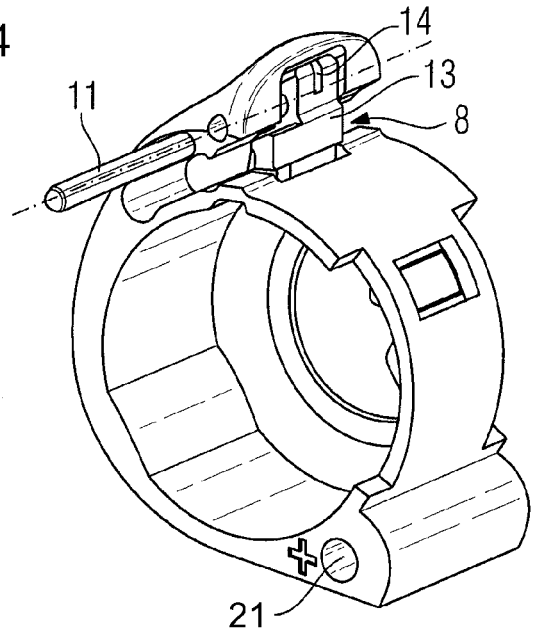
FIG. 14 is an isolated perspective illustration of a battery compartment according to an exemplary embodiment of the invention.

Referring now to the figures of the drawing in detail and first, particularly, to FIG. 1 thereof, there is shown a prior art hearing aid 1 with a microphone opening 2, a volume control 3, a programming socket 4, a program key 5 with an off function and a battery compartment 6 with a locking mechanism.

In each case in the form of a perspective view, FIGS. 2 to 4 show the lower end of the hearing aid 1 of FIG. 1 with the battery compartment 6. The perspective illustration has been rotated somewhat in comparison to FIG. 1 in order to allow the opening and closing of the battery compartment 6, as illustrated in FIGS. 2 to 4, to be seen better.

FIG. 2 shows the opening of the battery compartment 6 by pivoting the same out of the housing 7 of the hearing aid 1. On one side, the battery compartment 6 is connected to the housing 7 via a pivoting shaft that extends through or into a hole 21 (cf. FIGS. 6, 14), and the locking mechanism is located on the other side. Here, only the slide 8 of the locking mechanism can be seen.

FIG. 3 shows the battery compartment 6 in an open state, as a battery 9 is being inserted into the battery compartment 6.

FIG. 4 shows the battery compartment 6 is it is being closed by pivoting the same into the housing 7.

FIG. 5 uses an enlarged perspective illustration to once again show the lower end of the hearing aid 1 with the battery compartment 6. This illustrates how the locking mechanism can be locked and unlocked by using a screwdriver 10 to move the slide 8. The shaft 11, which guides the slide 8, is also indicated.

FIG. 6 shows a perspective illustration of the battery compartment 6 with the locking mechanism. In order to make it easier to identify, the shaft 11 has been illustrated outside the hole 12 in the battery compartment, in which the shaft 11 is otherwise located. The illustration also shows the slide 8, which can be moved along the shaft 11. The slide 8 has a locking bolt 13 which engages in a locking holder in the housing 7 of the hearing aid 1 in order to lock the battery compartment. In order to allow the locking mechanism to be operated using a screwdriver, the slide furthermore has a notch 14 in which the screwdriver 10 can engage. The notch is also accessible from the outside when the battery compartment 6 is closed, as can be seen in FIG. 5.

FIGS. 7 and 8 respectively show a cross section and a longitudinal section through the shaft 11. The shaft 11 has a substantially cylindrical shape with a circular cross section.

FIG. 9 shows a cross section through the battery compartment 6 as shown in FIG. 6. In this illustration, the shaft 11 is correctly located in the hole 12 in the battery compartment 6. The hole 12 passes through the battery compartment 6 on both sides, in such a way that the fit between the shaft 11 and the hole 12 must offer sufficient retention that the shaft does not slide out of the hole 12 during movement of the hearing aid 1 or during movement of the slide 8 on the shaft 11.

FIG. 10 shows a detail of the battery compartment shown in FIG. 9 along the section plane X-X in FIG. 9. The section surface runs transversely through the shaft 11 in an area in which the shaft 11 is inserted in the hole 12 of the battery compartment 6.

FIG. 11 shows a detail of a cross section through the battery compartment 6 along the section plane XI-XI in FIG. 9. The section surface once again runs transversely with respect to the shaft 11, but on this occasion in an area in which the shaft 11 runs through the hole in the slide 8.

FIGS. 12 and 13 respectively show an enlarged detail from FIG. 10 and FIG. 11. The enlarged details show the shaft 11 in the respective hole.

FIGS. 6 to 13 each illustrate scale drawings relating to a battery compartment from the prior art. Furthermore, FIGS. 6 and 9 to 11 are also on the same scale as one another.

The basic structure in FIGS. 14 to 21 corresponds to that in the already described FIGS. 6 to 13. Here, however, the shaft 11 has a trilobular cross section, according to one exemplary embodiment of the present invention.

Figure 15:
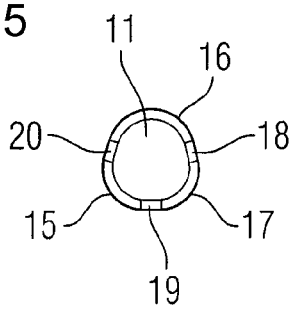
FIG. 15 is a cross-section through the shaft of FIG. 14.
Figure 16:
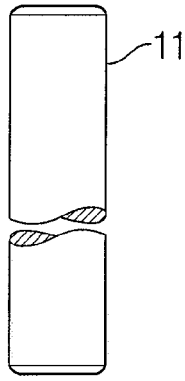
FIG. 16 is a broken side-elevation thereof.

FIGS. 15 and 16 respectively show a cross section through and a longitudinal elevation of the shaft 11.

The trilobular cross section of the shaft 11 can be seen in particular in FIG. 15. The external contour has three circular segments 15 to 17 and three straight pieces 18 to 20 between the circular segments 15 to 17. The circular segments 15 to 17 each correspond to one third of a complete circle. The shape of this cross section is not circular, because of the straight intermediate pieces 18 to 20. The symmetrical insertion of straight pieces 18 to 20 of the same length in each case means that the cross section of the shaft 11 is rotationally symmetrical when rotated through 120° about the center point of the cross section (n=3).

Figure 17:
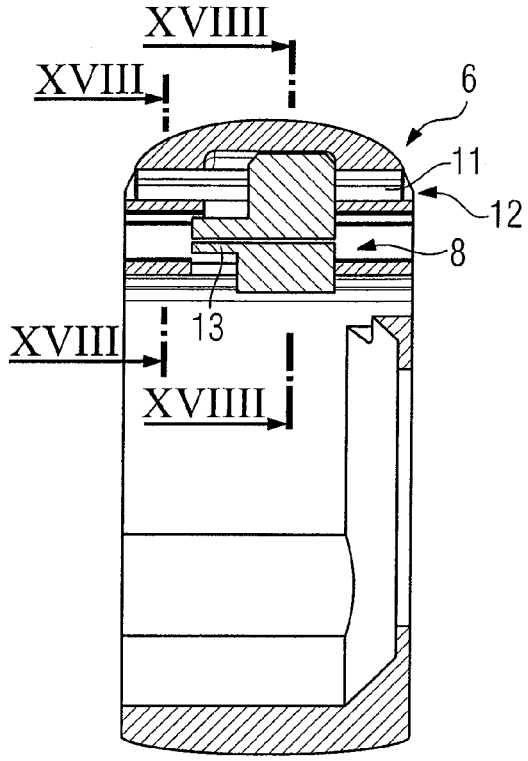
FIG. 17 is a cross-sectional view through the battery compartment of FIG. 14.
Figure 18:
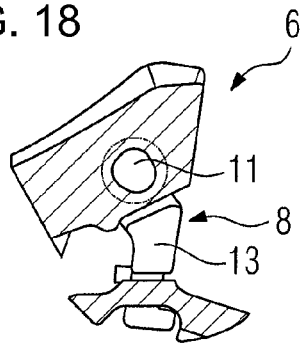
FIGS. 18-21 are various cross-sections through the battery compartment according to the invention.
Figure 19:
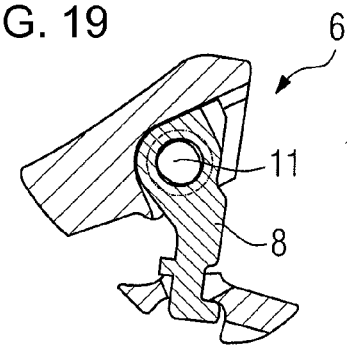

FIG. 18 shows the section XVIII-XVIII indicated in FIG. 17, and FIG. 19 shows the section XVIIII-XVIIII indicated in FIG. 17.

Figure 20:
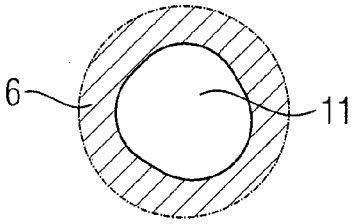

The enlarged illustration in FIG. 20 shows the fit between the shaft on the one hand and the hole 12 in the battery compartment 6 on the other hand. The hole 12 in the battery compartment 6 has the same trilobular cross section as the shaft 11 as a result of which, on the one hand, the shaft 11 is protected against rotation along the longitudinal axis of the shaft 11 in the hole 12 and, on the other hand, this ensures that the shaft 11 is very firmly seated in the hole 12 by the shaft 11 making contact with the hole 12 over the entire circumference, thus preventing it from sliding along the longitudinal direction of the shaft 11.

Figure 21:
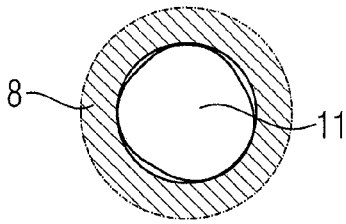

FIG. 21 shows the fit between the shaft 11 on the one hand and the hole in the slide 8 on the other hand. In contrast to the hole 12 in the battery compartment, the cross section of the hole in the slide 8 is not the same as the cross section of the shaft 11. The cross section of the hole through the slide 8 is circular, as a result of which the shaft 11 makes contact with the wall of the hole in the slide 8 only at the outermost points of the circular segments 15 to 17. This reduces the static friction and allows the slide 8 to be moved on the shaft 11 without major resistance.

The fit between the shaft 11 and the hole in the slide 8 is an interference fit, thus ensuring that the slide 8 is held securely against inadvertently sliding, without exerting a force on the slide 8 in the direction of the longitudinal axis of the shaft 11. On the one hand, the interference fit is designed such that a specific threshold value of a force must be exceeded in the direction of the longitudinal axis of the shaft 11 before the slide 8 moves on the shaft 11. This force threshold value is of such a magnitude that it is not exceeded simply by movement (for example shaking) of the hearing aid 1. On the other hand, the threshold value is of such a magnitude that it is exceeded without any effort by external application of the screwdriver 10 to the notch 14 in the slide 8.

The invention is not restricted to a trilobular cross section of the shaft 11. Any cross section which has the discrete rotational symmetry mentioned above is in principle suitable for this invention. FIGS. 22 to 26 illustrate a number of further examples.

Figure 22:
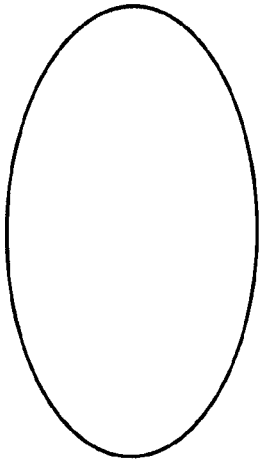
FIGS. 22-26 show illustrations of possible cross sections of the shaft.

FIG. 22 shows an ellipse (n=2).

Figure 23:
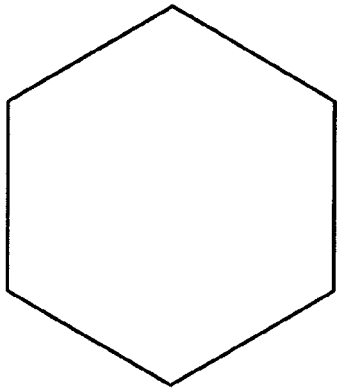

FIG. 23 shows a regular polygon in the form of a hexagon (n=6).

Figure 24:
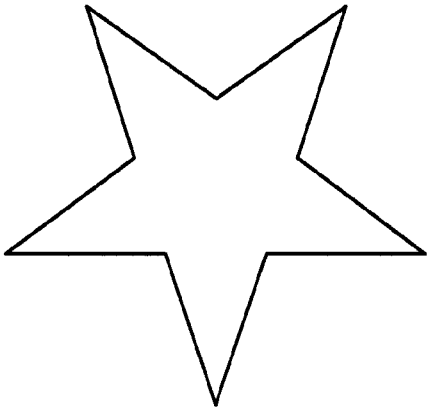

FIG. 24 shows a star with five corners (n=5).

Figure 25:
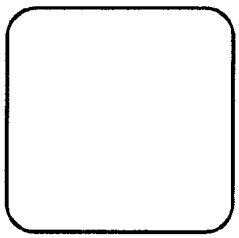

FIG. 25 shows a regular polygon in the form of a quadrilateral with rounded corners (n=4).

Figure 26:
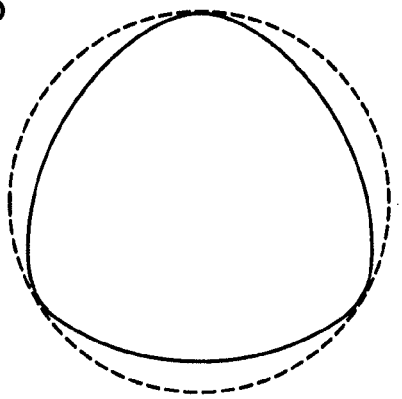

A trilobular shape can also be configured differently to that illustrated in FIG. 15. A further example is shown in FIG. 26. The example shown in FIG. 26 is similar to a continuously rounded triangle.

The invention claimed is:

1. A hearing aid, comprising:

a housing;

a battery compartment disposed in said housing; and a locking mechanism for the battery compartment, said locking mechanism including a shaft disposed on said housing or said battery compartment and a slide having a hole forming a fit with said shaft, wherein said slide is movable on said shaft in order to selectively lock and unlock said battery compartment in said housing;

said hole having a substantially circular cross section and said shaft having a non-circular cross section with rotational symmetry upon being rotated through 360°/n, where n is an integer and is at least 2.

2. The hearing aid according to claim 1, wherein a cross section of said shaft is elliptical.

3. The hearing aid according to claim 1, wherein a cross section of said shaft is trilobular.

4. The hearing aid according to claim 1, wherein a cross section of said shaft is a regular polygon.

5. The hearing aid according to claim 4, wherein the regular polygon has rounded corners.

6. The hearing aid according to claim 1, wherein a cross section of said shaft is a star shape.

7. The hearing aid according to claim 6, wherein the star shape has rounded corners.

8. The hearing aid according to claim 1, wherein the cross sections of said hole in said slide and of said shaft are interchanged.

9. The hearing aid according to claim 1, wherein the fit between said hole in said slide on the one hand and said shaft on the other hand is an interference fit.

10. The hearing aid according to claim 1, wherein said shaft is disposed on said housing or said battery compartment by a fit between said shaft on the one hand and a hole in said housing or said battery compartment on the other hand, with said hole and said shaft having a common cross section.

11. The hearing aid according to claim 10, wherein the fit between said hole in said housing or said battery compartment on the one hand and said shaft on the other hand is an interference fit.

12. A battery compartment for a hearing aid with a housing and a battery compartment locking mechanism, comprising:

a shaft mounted to the battery compartment;

a slide having a hole forming a fit with said shaft, wherein said slide is movably disposed on said shaft for selectively locking and unlocking the battery compartment in the housing of the hearing aid;

said hole having a circular cross section and said shaft having a non-circular a cross section with rotational symmetry, upon rotation through 360°/n, where n is an integer and is at least 2.

13. The battery compartment according to claim 12, wherein said shaft is disposed on said battery compartment by a fit between said shaft on the one hand and a hole in the battery compartment on the other hand, with said hole and said shaft having a common cross section.

14. The battery compartment according to claim 13, wherein the fit between said hole in said battery compartment and said shaft is an interference fit.

* * * * *